US011110504B1

(12) United States Patent
Zhang et al.

(10) Patent No.: US 11,110,504 B1
(45) Date of Patent: Sep. 7, 2021

(54) METHOD OF FORMING THICK-WALLED CYLINDER BY SPINNING

(71) Applicant: YANSHAN UNIVERSITY, Hebei (CN)

(72) Inventors: Lili Zhang, Hebei (CN); Junting Luo, Hebei (CN); Jiacheng Yu, Hebei (CN); Chunxiang Zhang, Hebei (CN)

(73) Assignee: YANSHAN UNIVERSITY, Qinghuangdao (CN)

( * ) Notice: Subject to any disclaimer, the term of this patent is extended or adjusted under 35 U.S.C. 154(b) by 0 days.

(21) Appl. No.: 17/205,454

(22) Filed: Mar. 18, 2021

(30) Foreign Application Priority Data

Mar. 26, 2020 (CN) ..... 202010221824.7

(51) Int. Cl.
*B21C 23/20* (2006.01)
*B21D 22/16* (2006.01)
*B21C 23/18* (2006.01)

(52) U.S. Cl.
CPC ..... *B21D 22/16* (2013.01); *B21C 23/186* (2013.01); *B21C 23/20* (2013.01); *B21C 23/18* (2013.01)

(58) Field of Classification Search
CPC ..... B21C 23/005; B21C 23/04; B21C 23/18; B21C 23/183; B21C 23/186; B21C 23/20; B21C 25/02; B21C 25/08; B21C 23/08; B21C 23/212; B21C 23/14; B21D 22/16
See application file for complete search history.

(56) References Cited

U.S. PATENT DOCUMENTS 2,096,018 A * 10/1937 Wright ..... B21D 51/44 72/68
4,166,373 A * 9/1979 Braun ..... B21C 23/03 470/16
4,300,378 A * 11/1981 Thiruvarudchelvan ... B21C 3/12 72/253.1
5,737,959 A * 4/1998 Korbel ..... B21B 1/166 72/256
10,109,418 B2 * 10/2018 Cui ..... H01F 41/0266
(Continued)

FOREIGN PATENT DOCUMENTS

CN 103878199 A 6/2014
CN 104624694 A 5/2015
(Continued)

OTHER PUBLICATIONS

Translation; JP 2005-996 A, Mizunuma et al.; Jan. 2005.*

*Primary Examiner* — Edward T Tolan

(57) ABSTRACT

A method of forming a cylinder by spinning. A cylindrical blank is placed at a geometric center of a lower mold cavity, where a bottom of the lower mold cavity is provided with a straight hole, and a blank block is provided at the straight hole. The lower mold cavity is fixed on a rotating worktable such that the blank is directly below an upper indenter. The indenter is driven by an extruder to move vertically downwards to extrude the cylindrical blank. Meanwhile, the lower mold cavity is driven by the worktable to uniform rotate. The intender is kept still, and the lower mold cavity is continuously driven to rotate. The lower mold cavity moves vertically upwards to process an outer surface of the blank by rotation of a petal-shape inner wall. The formed cylinder is separated from the lower mold cavity to obtain the desired cylinder.

1 Claim, 5 Drawing Sheets

(56) References Cited

U.S. PATENT DOCUMENTS

| | | | | |
|---|---|---|---|---|
| 10,265,746 | B2 * | 4/2019 | Zhang | B21C 23/085 |
| 10,814,370 | B2 * | 10/2020 | Zhang | B21C 23/085 |
| 2014/0007640 | A1 * | 1/2014 | Endo | B21C 23/183<br>72/352 |

FOREIGN PATENT DOCUMENTS

| | | | | | |
|---|---|---|---|---|---|
| CN | 106363031 | A | | 2/2017 | |
| CN | 106424188 | A | | 2/2017 | |
| CN | 107262542 | A | | 10/2017 | |
| CN | 108348971 | A | | 7/2018 | |
| CN | 108723106 | A | | 11/2018 | |
| CN | 109590348 | A | | 4/2019 | |
| CN | 210172297 | U | | 3/2020 | |
| DE | 102012005106 | A1 | * | 9/2019 | B21C 23/02 |
| JP | 2005-996 | A | * | 1/2005 | B21C 25/02 |
| JP | 2009172657 | A | | 8/2009 | |
| PL | 224122 | B1 | | 11/2016 | |
| WO | 97/36701 | A1 | * | 10/1997 | B21C 23/20 |

* cited by examiner

METHOD OF FORMING THICK-WALLED CYLINDER BY SPINNING

CROSS-REFERENCE TO RELATED APPLICATIONS

This application claims the benefit of priority from Chinese Patent Application No. 202010221824.7 filed on Mar. 26, 2020. The content of the aforementioned application, including any intervening amendments thereto, is incorporated herein by reference in its entirety.

TECHNICAL FIELD

This application relates to forming processes of cylinders, and more particularly to a method of forming a thick-walled cylinder by spinning.

BACKGROUND

Thick-walled cylinders are widely used in modern industrial equipment such as high-pressure vessels. Generally, the thick-walled cylinders are molded through deep drawing, which will cause molding defects inside the molded product, ultimately leading to a failure during use. Therefore, it is necessary to design a process for forming thick-walled cylinders, so as to reduce the internal defects of the formed product and ensure the size at the same time.

SUMMARY

An object of the present disclosure is to provide a method of forming a thick-walled cylinder by spinning, to solve the above-mentioned problems in the prior art, extending a service life of the thick-walled cylinder.

The technical solutions of the present disclosure are described as follows.

This application provides a method of forming a cylinder by spinning, comprising:

(1) placing a cylindrical blank at a geometric center of a lower mold cavity;

wherein a bottom of the lower mold cavity is provided with a straight hole; and a blank block is arranged at the straight hole;

(2) fixedly arranging the lower mold cavity on a rotating worktable such that the cylindrical blank is directly below an upper indenter;

driving the upper indenter to move vertically downwards by an extruder to extrude the cylindrical blank to perform an extrusion process; and simultaneously driving the lower mold cavity by the rotating worktable to rotate uniformly around a central axis of the cylindrical blank;

(3) after the extrusion process is completed, keeping the upper intender still; and keeping the lower mold cavity rotating uniformly; and (4) moving the lower mold cavity vertically upwards while being driven by the rotating worktable to rotate to allow a petal-shape inner wall of the lower mold cavity to process an outer surface of the cylindrical blank by rotation; and separating the lower mold cavity from the blank block to allow a formed cylinder to be separated from the lower mold cavity to obtain the desired cylinder.

In some embodiments, a diameter of the blank block is the same as that of the straight hole.

In some embodiments, the blank block is configured to support the cylindrical blank.

In some embodiments, the lower mold cavity has a wavy-shaped inner wall in circumferential direction; the lower mold cavity has a taper in a vertical direction, and an area of the cross section of the lower mold cavity decreases from a top to a bottom.

In some embodiments, the upper indenter is cylindrical, and a diameter of the upper indenter is the same as an inner diameter of the cylinder.

In some embodiments, in step (2), the lower mold cavity is rotated along a single direction.

The beneficial effects of the present disclosure are described as follows.

This disclosure provides a method of molding a cylinder though extrusion and rotation, which improves a service life of the cylinder. The method reduces the internal defects of the thick-walled straight cylinder in the traditional extrusion or drawing process, increasing a service life of the thick-walled cylinder. A wavy-shaped inner wall of the lower mold cavity helps the cylinder to rotate during extrusion, and increases a smoothness of an outer wall of the cylinder during the molding. A single mold step-by-step deformation process reduces mold design and processing costs, and improves the production efficiency of thick-walled cylinders.

BRIEF DESCRIPTION OF THE DRAWINGS

The technical solutions of the prior art and the present disclosure will be further described clearly with reference to the accompanying drawings. Obviously, presented below are merely some embodiments of this disclosure, and are not intended to limit this disclosure. It should be understood that other embodiments made by those skilled in the art based on the content disclosed herein without sparing any creative effort should fall within the scope of the disclosure defined by the appended claims.

Figure 1:
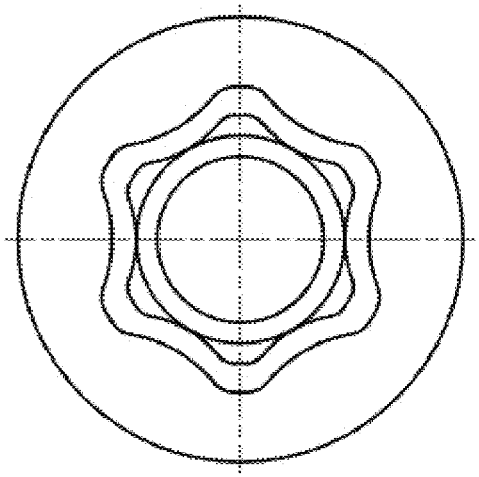
FIG. 1 is a schematic diagram showing an initial stage of a method of forming a cylinder by spinning according to an embodiment of the present disclosure.

in the drawings, 1, upper indenter; 2, lower mold cavity; 3, blank; and 4, blank block.

DETAILED DESCRIPTION OF EMBODIMENTS

The technical solutions of the present disclosure will be further described clearly with reference to the accompanying drawings in the embodiments. Obviously, provided below are merely some embodiments of this disclosure, and not all the embodiments of this disclosure. Other embodiments made by those skilled in the art without departing from the spirit of this disclosure should fall within the scope of the disclosure defined by the appended claims.

An object of the present disclosure is to provide a method of forming a thick-walled cylinder by spinning, to solve the above-mentioned problems in the prior art, extending a service life of the thick-walled cylinder.

The objects, technical solutions and beneficial effects of the present disclosure are further described clearly with reference to the accompanying drawings and the embodiments.

Figure 2:
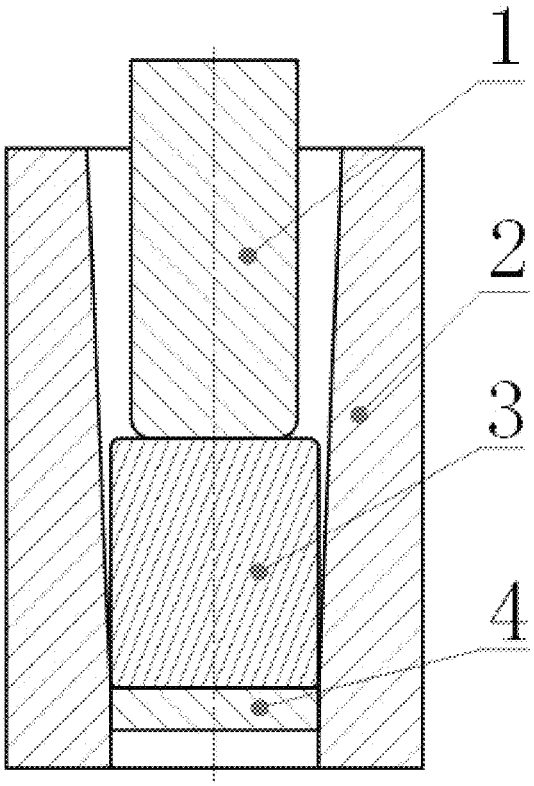
FIG. 2 is another schematic diagram depicting the initial stage of the method of forming a cylinder by spinning according to an embodiment of the present disclosure.
Figure 3:
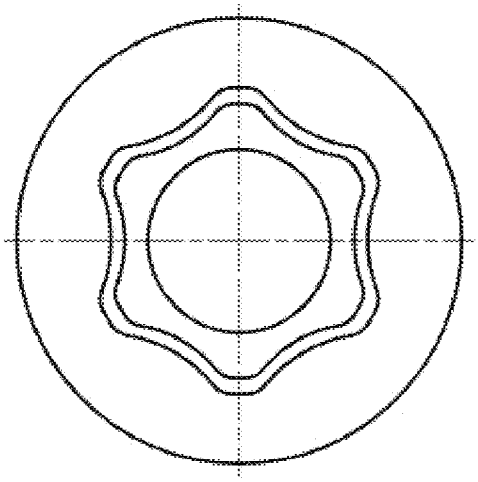
FIG. 3 is a schematic diagram depicting a loading process of the method of forming a cylinder by spinning according to an embodiment of the present disclosure.
Figure 4:
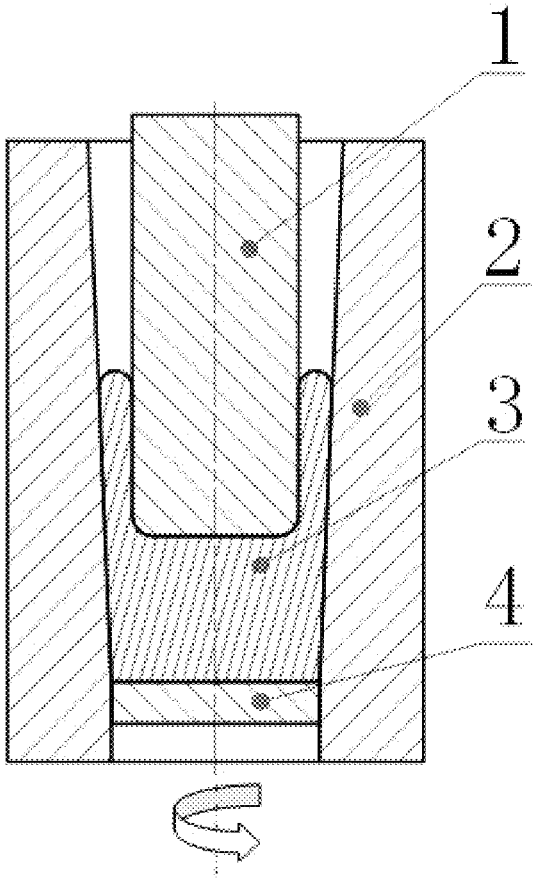
FIG. 4 is another schematic diagram depicting the loading process of the method of forming a cylinder by spinning according to an embodiment of the present disclosure.
Figure 5:
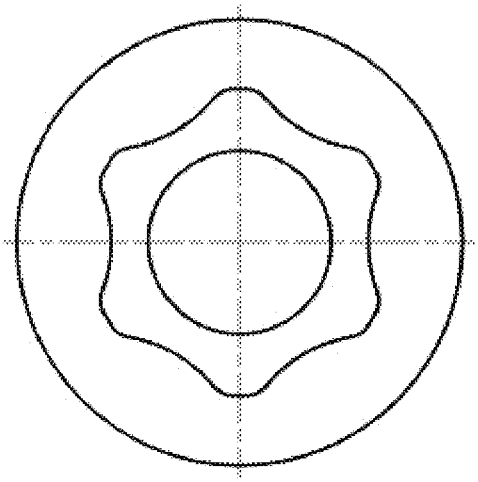
FIG. 5 is a schematic diagram depicting the completion of the loading of the method of forming a cylinder by spinning according to an embodiment of the present disclosure.
Figure 6:
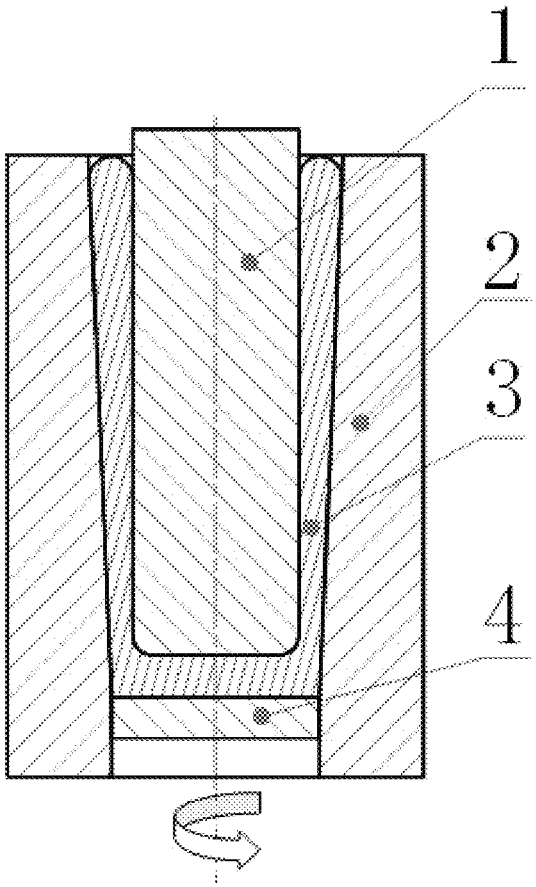
FIG. 6 is another schematic diagram depicting the completion of the loading of the method of forming a cylinder by spinning according to an embodiment of the present disclosure.
Figure 7:
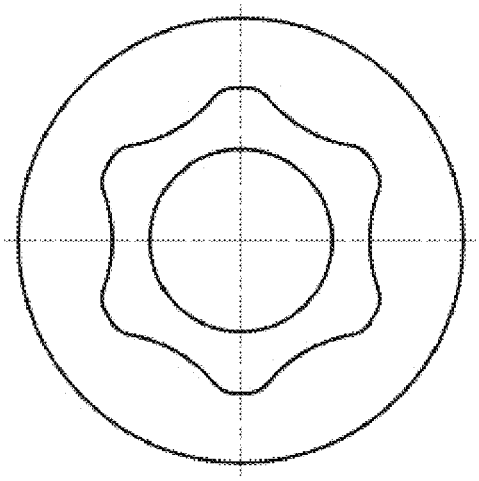
FIG. 7 is a schematic diagram depicting a spinning process of the method of forming a cylinder by spinning according to an embodiment of the present disclosure.
Figure 8:
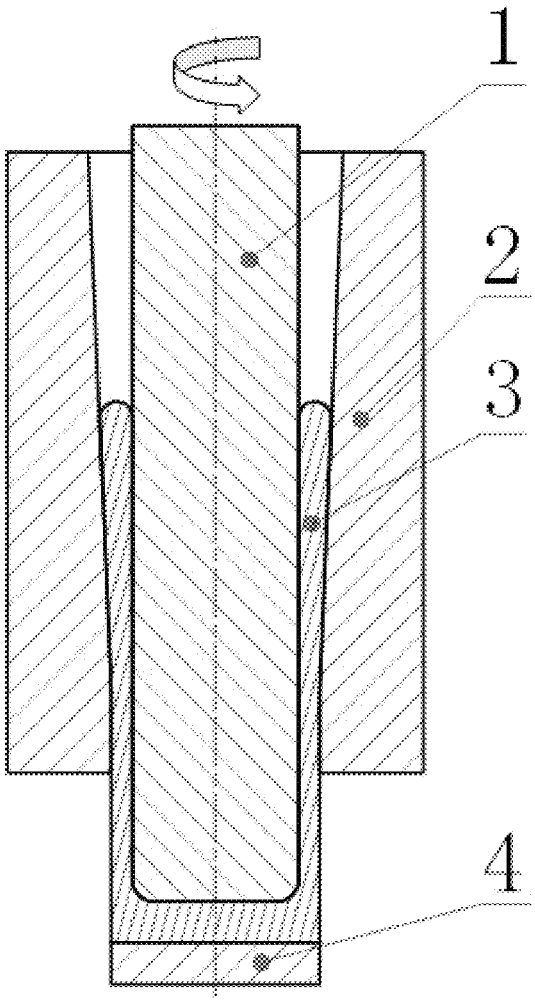
FIG. 8 is another schematic diagram depicting the spinning process of the method of forming a cylinder by spinning according to an embodiment of the present disclosure.
Figure 9:
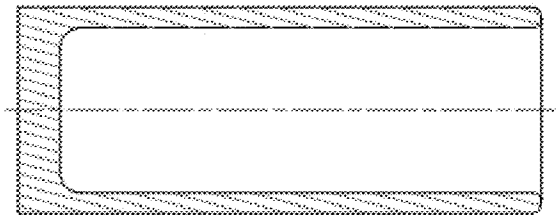
FIG. 9 schematically depicts a structure of a cylinder prepared by the method of forming a cylinder by spinning according to an embodiment of the present disclosure.

As shown in FIGS. 1-9, this disclosure provides a method of forming a thick-walled cylinder by spinning, which is described as follows.

(1) A cylindrical blank 3 is placed at a geometric center of a lower mold cavity 2. A bottom of the lower mold cavity 2 is provided with a straight hole. A blank block 4 is arranged at the straight hole. A diameter of the blank block 4 is the same as that of the straight hole. The blank block 4 is configured to support the cylindrical blank 3. In this embodiment, the blank block 4 is placed in the straight hole, and there is no mechanical connection between the blank block 4 and a bottom of the lower mold cavity 2. The lower mold cavity 2 has a wavy-shaped inner wall in circumferential direction. The lower mold cavity 2 has a taper in a vertical direction, and an area of the cross section of the lower mold cavity 2 decreases from a top to a bottom.

(2) The lower mold cavity 2 is fixedly arranged on a rotating worktable such that the cylindrical blank 3 is directly below an upper indenter 1. The upper indenter 1 is driven to move vertically downwards by an extruder, so as to extrude the cylindrical blank 3 to perform an extrusion process. At the same time, the lower mold cavity 2 is driven by the rotating worktable to rotate uniformly around a central axis of the cylindrical blank 3. The upper indenter 1 is cylindrical, and a diameter of the upper indenter 1 is the same as an inner diameter of the cylinder.

(3) After the extrusion process, the upper intender 1 is kept still, and the lower mold cavity 2 is kept rotating uniformly.

(4) The lower mold cavity 2 is driven by the rotating worktable to move vertically upwards to allow a petal-shape inner wall of the lower mold cavity 2 to process an outer surface of the cylindrical blank 3 by rotation. The lower mold cavity 2 is separated from the blank block 4 to allow a formed cylinder to be separated from the lower mold cavity 2 obtain the desired cylinder.

The method provided herein reduces the internal defects of the thick-walled straight cylinder in the traditional extrusion or drawing process, extending a service life of the thick-walled cylinder. A wavy-shaped inner wall of the lower mold cavity 2 helps the cylinder to rotate during the extrusion, and increases a smoothness of an outer wall of the cylinder during the forming. The single mold-based stepwise deformation process reduces mold design and processing costs, and improves the production efficiency of thick-walled cylinders.

As used herein, the orientation or positional relationship indicated by the terms such as "top", "bottom", "vertical" and "inner" are based on the orientation or positional relationship shown in the drawings. These terms are intended to better describe this disclosure and simplify the description, and does not indicate or imply that the device or element referred to must have a specific orientation, and be constructed and operated in a specific orientation. Therefore, these terms cannot be understood as a limitation to the present disclosure.

The embodiments provided herein are merely illustrative of the disclosure, and are not intended to limit this disclosure. Modifications and variations made by those skilled in the art without departing from the spirit of the present disclosure should still fall within the scope of the disclosure.

What is claimed is:

1. A method of molding a cylinder though extrusion and rotation, comprising:

(1) placing a cylindrical blank at a geometric center of a lower mold cavity;

wherein a bottom of the lower mold cavity is provided with a straight hole; a blank block is arranged at the straight hole; a diameter of the blank block is the same as that of the straight hole; the blank block is configured to support the cylindrical blank; the lower mold cavity has a wavy-shaped inner wall in circumferential direction; the lower mold cavity has a taper in a vertical direction; and an area of the cross section of the lower mold cavity decreases from a top to a bottom;

(2) fixedly arranging the lower mold cavity on a rotating worktable such that the cylindrical blank is directly below an upper indenter;

driving the upper indenter to move vertically downwards by an extruder, so as to extrude the cylindrical blank to perform an extrusion process; and simultaneously driving the lower mold cavity by the rotating worktable to rotate uniformly around a central axis of the cylindrical blank;

wherein the upper indenter is cylindrical; and a diameter of the upper indenter is the same as an inner diameter of the cylinder;

(3) after the extrusion process is completed, keeping the upper intender still; and keeping the lower mold cavity rotating uniformly; and (4) moving the lower mold cavity vertically upwards while being driven by the rotating worktable to rotate to allow the wavy-shaped inner wall of the lower mold cavity to process an outer surface of the cylindrical blank by rotation; and separating the lower mold cavity from the blank block to allow a formed cylinder to be separated from the lower mold cavity to obtain the desired cylinder.

* * * * *